US006868852B2

(12) United States Patent
Gaschke

(10) Patent No.: US 6,868,852 B2
(45) Date of Patent: Mar. 22, 2005

(54) COLD WEATHER BREATHING APPARATUS

(76) Inventor: Paul Gaschke, 97 Old Hopewell Rd., Wappinger Falls, NY (US) 12590

( * ) Notice: Subject to any disclaimer, the term of this patent is extended or adjusted under 35 U.S.C. 154(b) by 0 days.

(21) Appl. No.: 09/822,606

(22) Filed: Apr. 2, 2001

(65) Prior Publication Data

US 2002/0139366 A1 Oct. 3, 2002

(51) Int. Cl.[7] ..... A62B 18/08
(52) U.S. Cl. ..... 128/201.13; 128/201.29
(58) Field of Search ..... 128/200.24, 200.27, 128/200.28, 201.13, 201.15, 201.17, 201.22, 201.23, 201.24, 201.25, 201.26, 201.29, 202.11, 205.25, 206.12, 206.18, 206.19, 206.21, 206.28, 206.29, 207.13, 202.16, 204.17, 857, 863; 2/171, 173, 202, 206, 207, 208, 424

(56) References Cited

U.S. PATENT DOCUMENTS

| | | | | | |
|---|---|---|---|---|---|
| 838,434 | A | * | 12/1906 | Morgan | 128/206.18 |
| 1,050,621 | A | * | 1/1913 | Ford | 128/204.17 |
| 1,077,042 | A | * | 10/1913 | Cooper | 128/863 |
| 1,139,850 | A | * | 5/1915 | Conkle | 128/201.22 |
| 1,166,462 | A | * | 1/1916 | King | 128/863 |
| 1,171,973 | A | * | 2/1916 | Patterson | 128/863 |
| 1,202,510 | A | * | 10/1916 | Grindle | 128/863 |
| 2,238,492 | A | * | 4/1941 | Leguillon | 128/206.28 |
| 2,260,701 | A | * | 10/1941 | Boothby et al. | 128/206.21 |
| 2,348,074 | A | * | 5/1944 | Lambertsen | 128/201.13 |
| 2,452,845 | A | * | 11/1948 | Fisher | 128/200.27 |
| 2,751,905 | A | * | 6/1956 | Creelman | 128/863 |
| 3,288,138 | A | * | 11/1966 | Sachs | 128/863 |
| 3,500,825 | A | * | 3/1970 | Andersson et al. | 128/863 |
| 3,736,928 | A | * | 6/1973 | Andersson et al. | 128/863 |
| 3,814,094 | A | | 6/1974 | Angelis | |
| 4,141,086 | A | * | 2/1979 | Jackson | 2/2.1 |
| 4,150,671 | A | * | 4/1979 | Tiger | 128/201.13 |
| 4,269,183 | A | * | 5/1981 | Hunt | 128/201.13 |
| 4,300,240 | A | * | 11/1981 | Edwards | 2/206 |
| 4,412,537 | A | * | 11/1983 | Tiger | 128/204.17 |
| 4,441,494 | A | | 4/1984 | Montalbano | |
| 4,458,679 | A | * | 7/1984 | Ward | 128/201.13 |
| 4,461,292 | A | | 7/1984 | Montalbano | |
| 4,473,071 | A | * | 9/1984 | Hunt | 128/201.13 |
| 4,610,247 | A | * | 9/1986 | Stroup | 128/201.28 |
| 4,641,379 | A | | 2/1987 | Martin | |
| 4,671,268 | A | | 6/1987 | Hunt | |
| 4,768,235 | A | * | 9/1988 | Webster | 2/205 |
| 4,825,474 | A | | 5/1989 | Edwards | |
| 4,895,143 | A | * | 1/1990 | Fisher | 128/206.29 |
| 4,941,211 | A | * | 7/1990 | Bluestein | 2/202 |
| 4,971,051 | A | * | 11/1990 | Toffolon | 128/206.26 |
| 5,018,519 | A | * | 5/1991 | Brown | 128/203.29 |
| 5,214,804 | A | | 6/1993 | Carey | |
| 5,243,972 | A | * | 9/1993 | Huang | 128/205.25 |
| 5,265,595 | A | * | 11/1993 | Rudolph | 128/204.18 |
| 5,431,158 | A | * | 7/1995 | Tirotta | 128/206.21 |

(List continued on next page.)

*Primary Examiner*—Henry Bennett
*Assistant Examiner*—Teena Mitchell
(74) *Attorney, Agent, or Firm*—Woodard, Emhardt, Moriarty McNett & Henry LLP

(57) ABSTRACT

A cold weather breathing device that protects the face including the mouth and nostril area from direct exposure to the external environment, prevents a user's goggles from fogging in cold environments, and keeps moist exhaled breath away from the user's face. In a preferred embodiment, the device is configured to provide separate breathing channels for exhaled air from the mouth and nose. To promote ease of cleaning, the breathing device can be attached to a head garment with a simple interlocking design that allows its removal and separate cleaning. The breathing device provides a nose-channel-forming member and mouth disc that are mounted on the head garment and inset into a mouth-channel-forming member which is thus attached to the head garment.

20 Claims, 8 Drawing Sheets

U.S. PATENT DOCUMENTS 5,460,174 A * 10/1995 Chang ..... 128/204.25
D369,442 S * 4/1996 Jones ..... D29/108
5,511,541 A * 4/1996 Dearstine ..... 128/201.13
5,551,087 A * 9/1996 Blutstein et al. ..... 2/173
5,575,009 A 11/1996 Ryvin
5,595,174 A * 1/1997 Gwaltney ..... 128/201.15
5,704,068 A * 1/1998 Martin ..... 2/173
5,839,432 A * 11/1998 Daneshvar ..... 128/201.25
5,884,336 A 3/1999 Stout
6,019,101 A * 2/2000 Cotner et al. ..... 128/207.13
6,263,874 B1 * 7/2001 LeDez et al. ..... 128/206.21
6,272,690 B1 * 8/2001 Carey et al. ..... 2/206
6,371,116 B1 * 4/2002 Resnick ..... 128/206.24

* cited by examiner

COLD WEATHER BREATHING APPARATUS

The present invention relates to a type of head garment primarily intended for, but not limited to, use in cold weather activities such as skiing, motorcycling or snow-mobiling. More particularly, it pertains to a breathing apparatus which is attached to a protective head garment.

BACKGROUND OF INVENTION

While engaging in cold weather activities, a participant's face is frequently covered with protective gear such as a hat, goggles and a neck garment. Sometimes the neck garment and hat are combined into a unified head garment. "Head garment" as used herein refers to either a neck garment that also covers the face or a combined hat/neck garment. Although it is common practice to leave the nose and mouth exposed for ease of breathing and to prevent the user's goggles from fogging, there are conditions, such as extremely cold temperatures, when the user will also want to cover his ("his" is used in a generic sense to mean both genders) nose and mouth with a warm protective material. This can create problems. Since the user has to breath through the material covering his nose and mouth, the flow of moist exhaled breath is restricted from passing through the material and typically finds a less restrictive path along the sides of the nose and into the goggles. Once in the goggle cavity, the moist breath condenses and freezes on the goggle lens impairing the user's vision. The moist exhaled breath can also permeate the head garment material and eventually freeze causing discomfort. Some head garment designs attempt to solve this problem by providing holes for the mouth and nostrils. This may solve the goggle fogging problem but leaves the small areas of skin around the mouth and nostrils directly exposed to the cold external environment which is uncomfortable and can leave the user susceptible to frost bite.

A cold weather hood disclosed in U.S. Letters Pat. No. 5,884,336 to Kathleen K. Stout, and cold weather breathing devices disclosed in U.S. Pat. Nos. 4,461,292 and 4,441,494 to Anthony P. Montalbano, U.S. Pat. No. 4,610,247 to Bert R. Stroup, U.S. Pat. No. 4,825,474 to Joseph H. Edwards, and U.S. Pat. No. 5,214,804 to Carey et al. all allow either the bottom of the nose or mouth or both to be directly exposed to the cold external environment.

The cold weather hoods disclosed in U.S. Letters Pat. No. 5,575,009 to David Ryvin, U.S. Pat. No. 4,141,086 to Allen F. Jackson, U.S. Pat. No. 4,671,268 to Patrick T. Hunt, U.S. Pat. No. 3,814,094 to Armand De Angelis and Albert J. Laliberte, and U.S. Pat. No. 4,641,379 to Thomas S. Martin all disclose single cavity devices that cover both the nose and mouth. This allows the moist breath to surround the nose and mouth creating a humid environment which is uncomfortable.

Finally, cold weather breathing devices disclosed in U.S. Letters Pat. Nos. 4,461,292 and 4,441,494 to Anthony P. Montalbano, U.S. Pat. No. 4,610,247 to Bert R. Stroup, U.S. Pat. No. 4,141,086 to Al/en F. Jackson, U.S. Pat. No. 4,671,268 to Patrick T. Hunt, and U.S. Pat. No. 3,814,094 to Armand De Angelis and Albert J. Laliberte all implement designs that use the body to preheat the air to be inhaled. These designs are complex, cumbersome and would impede the range of motion necessary in many cold weather activities. Furthermore, these designs create resistance to the flow of exhaled breath which can be uncomfortable and cause a user's goggles to fog.

SUMMARY OF THE INVENTION

An object of the invention is a cold weather breathing device that protects the face including the mouth and nostril area from direct exposure to the external environment, prevents a user's goggles from fogging in cold environments, and keeps moist exhaled breath away from the user's face.

Another object of the invention is a cold weather breathing device that permits free flow unobstructed breathing from both the nose and mouth while shielding these body parts from the external environment.

A first feature of the invention is a cold weather breathing device that separates the exhaled air from the mouth of a user from the exhaled air from his nose.

A second feature of the invention is a cold weather breathing device that provides separate breathing channels for exhaled air from the mouth and nose.

A third feature of the invention is a cold weather breathing device that directs the external air flow that may pass through the device away from the user's nose.

A fourth feature of the invention is a cold weather breathing device that allows separation and removal of the region of the device surrounding the nose and mouth from the rest of the cold weather breathing device so that it can be separately cleaned.

A fifth feature is a head garment construction design that fastens two panels of material such to create a pocket for the nose.

A sixth feature of the invention is a novel method of constructing a cold weather breathing device that exhibits one or more of the foregoing features.

In accordance with a preferred embodiment of the invention, the cold weather breathing device comprises a garment configured so that the material covering the nose is loosely fitted such that a seal is created when the garment material is sandwiched between a pair of goggles and the user's nose. Free flow breathing is obtained by providing two independent channels for the nose and mouth air flow that directs moist breath away from the face. This feature combined with the nose seal eliminates the tendency for the user's goggles to fog. Furthermore, the breathing device keeps the skin around the user's nose and mouth comfortably dry by isolating the nose breath from the mouth breath through the implementation of the independent breathing channels. In the preferred embodiment, both the nose and mouth are directly shielded from the external environment. To promote ease of cleaning, the breathing device can be attached to the head garment with a simple interlocking design that allows its removal and separate cleaning.

In accordance with another preferred embodiment, the head garment comprises an interlocking mouth disc with a hole near its center that aligns ,with the user's mouth and an interlocking nose channel with a first hole near its center that aligns with the user's nostrils and a second hole and an optional third hole open to the external environment. Both are made from a flexible thermally suitable material and the construction is configured so as to have a low resistance to the flow of breath to the external environment. These interlocking parts are fastened to the head garment such that the hole in the interlocking mouth disc aligns with a first hole in the head garment which aligns with the user's mouth and the first hole of the interlocking nose channel aligns with a second hole of the head garment which aligns with the user's nose. The head garment also comprises a mouth channel that has a first hole near its center that aligns with the user's mouth, a second hole above the first hole that aligns with the user's nostrils and a third hole and an optional fourth hole open to the external environment. Preferably, the third hole and optional fourth holes are provided such that their openings are directed both towards the user's face and in a somewhat downward direction. The mouth channel is made from a flexible thermally suitable material and has a low resistance to the flow of breath to the external environment. Preferably, the mouth channel is mounted to the garment by deforming the interlocking mouth disc and interlocking nose channel and forcing them through the first and second holes in the mouth channel, respectively, where they return to their original shape. Since the interlocking nose channel and interlocking mouth disc are fastened to the head garment and in turn interlock with the removable mouth channel, an attachment mechanism for connecting the mouth channel to the head garment is established.

In accordance with yet another preferred embodiment, the mouth channel is cut along one edge, preferably the bottom edge, and is also cut along the internal nose channel, preferably along "face side" of the barrier forming the nose channel. With these cuts the user can pivot the front of the device away from their face allowing quick access to their nose and mouth without removing the garment.

DETAILED DESCRIPTION OF THE INVENTION

Figure 1:
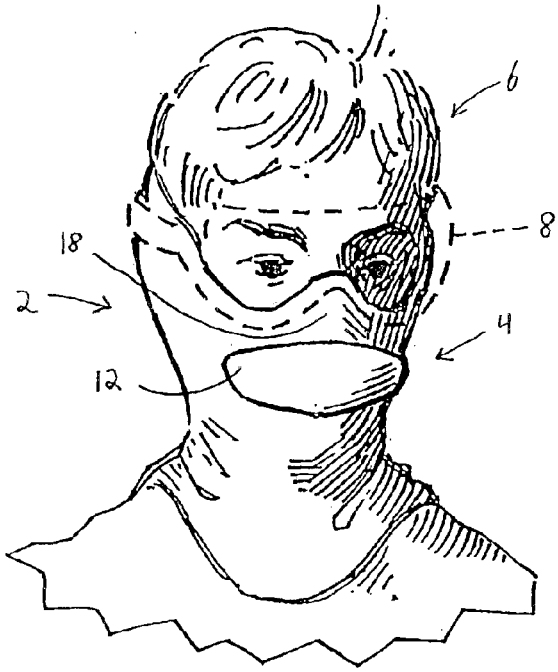
FIG. 1 illustrates a perspective view of one form of a head garment incorporating the cold weather breathing device according to the invention disposed about the head and face of a user, with goggles in dashed lines also shown.

The subject invention generally relates to a head garment 2 incorporating a cold weather breathing apparatus 4 according to the invention the head garment 2 is shown in wearing position on the head of a user 6, which breathing apparatus 4, among other things, facilitates free flow breathing and eliminates the tendency for a user's goggles 8 to fog. As shown in FIG. 1, the head garment comprises a soft insulating cloth of the type typically worn to protect against cold and wind, for example, fleece or wool, that is fitted about the head of the user 6 and typically extends down to protect the neck of the user. The garment, for simplicity and to fit persons of various sizes may be separated in the back as shown in FIG. 5 and provided with VELCRO bands 10, one or several spaced bands (only one of which is shown), to assist the user to fit the garment over his head.

A mouth-channel-forming member 12, which is made from a flexible, shape-holding thermally-suitable material, for example, soft silicon rubber or plastics (by "thermally-suitable" is meant a material that will remain pliable at cold temperatures and will ward off cold and wind), is shown attached to the head garment 2 so as to cover both a head garment nostril opening 14 and head garment mouth opening 16, not shown in FIG. 1, which are aligned with the nostrils and mouth, respectively, of the user. The head garment 2 is configured such as to create a nose pocket 18 that has a loose fit over the user's nose. Also referring to FIGS. 2, 3 and 4, the other parts of the cold weather breathing apparatus 4 include a removable generally tubular nose-channel-forming member 20 and mouth disc 22 both of which are inset inside the generally tubular mouth-channel-forming member 12 (inset views not shown). The nose-channel-forming member 20 and mouth disc 22 are also made from flexible, shape-holding thermally-suitable materials. The nose-channel-forming member 20 has on top a nose channel nostril port 24 surrounded by a nose channel flange 26. The mouth-channel-forming member 12 also has on top a second nostril port 28 into which the nose channel flange 26 is fitted (nested parts not shown). When the flexible nose-channel-forming member 20 is squeezed through the nostril port 28 in the mouth-channel-forming member 12 so as to nest inside the generally tubular mouth-channel-forming member 12, it springs back to its original shape such that the nose channel flange 26 protrudes through the similarly shaped nostril port 28 of the mouth-channel-forming member 12. While not visible in FIG. 1, the nose channel flange 26 is fitted to the head garment nostril opening 14 and is attached to the garment at the nose channel flange 26 by sewing or other means. The mouth disc 22 has a center hole 30 adapted to align with the not-shown head garment nostril opening 14. While not visible in FIG. 1, the mouth disc 22 is attached, as by sewing or other means, to the head garment 2 below the attached nose-channel-forming member 20, and the annular part 32 surrounding its center hole 30 nests inside the mouth hole 34 in the mouth-channel-forming member 12 and holds the head garment 2 attached to the mouth-channel-forming member 12 in its proper position. The annular part 32 surrounding the center hole 30 in the mouth disc 22, serves the interlocking function previously described which allows the mouth disc 22 to be removed from its position within the mouth-channel-forming member 12 for drying and cleaning. Similarly, the nested nose-channel-forming member 20 holds its position inside the tubular mouth-channel-forming member 12 by reason of the nose channel interlocking tube extensions 36 and nose channel flange 26 which is also the previously described interlocking function that also allows the nose-channel-forming member 20 to be removed from its position within the mouth-channel-forming member 12 for drying and cleaning. Each of the mouth-channel-forming member 12 and nose-channel-forming member 20 have at opposite ends intake/exhaust ports designated, respectively, 38 and 40.

Figure 2:
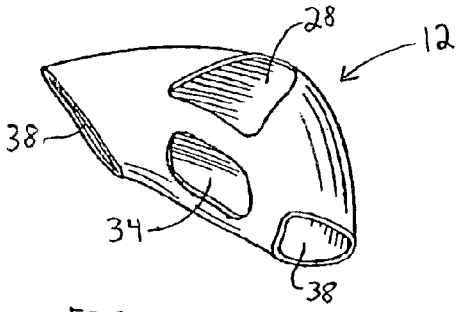
FIG. 2 is a back perspective view of one form of a mouth-channel-forming member incorporated in the head garment of FIG. 1.
Figure 3:
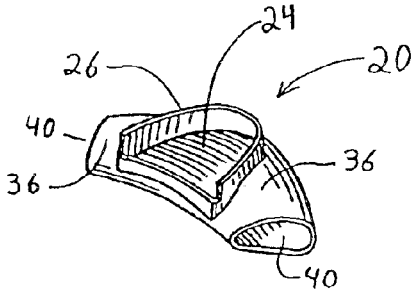
FIG. 3 is a front perspective view of one form of an interlocking nose-channel-forming member incorporated in the head garment of FIG. 1.
Figure 4:
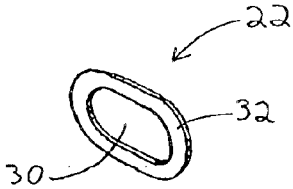
FIG. 4 is a front perspective view of one form of an interlocking mouth disk incorporated in the head garment of FIG. 1.

In FIG. 2, the mouth-channel-forming member 12 is shown orientated such that its two intake/exhaust ports 38, nostril port 28 and mouth hole 34 can be seen. When worn, the openings of the intake/exhaust ports 38 are directed both sideways and in a somewhat downward direction shielding these openings from wind and precipitation. Referring to FIG. 3, the nose-channel-forming member 20 is shown with it's nostril port 24 and the two intake/exhaust ports 40 in view. The nose channel interlocking tube extensions 36 and nose channel flange 26 can also be seen. FIG. 4 shows the mouth disc 22 with it's center hole 30 and annular part 32 identified. The channels and ports formed by and in these parts 12, 20, and 22 are large enough to produce a low resistance to the flow of breath through the head garment 2 and breathing apparatus 4 to the external environment. For example only, which is not to be limiting, the inside diameter of the tubes and the ports can be 1–3 cm in size.

Figure 5:
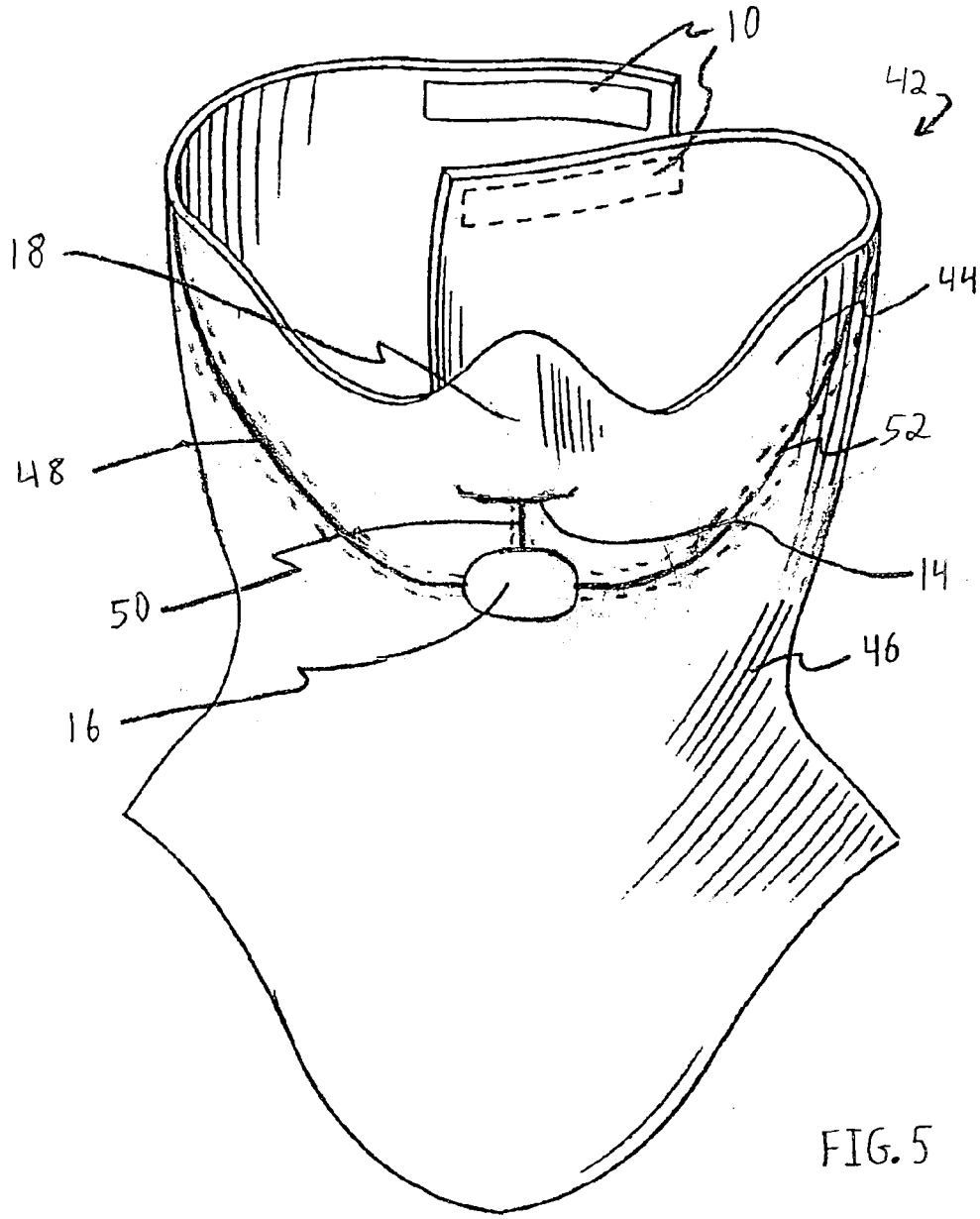
FIG. 5 is a front perspective view of a head garment fabric subassembly according to FIG. 1.

FIG. 5 is a front perspective view of a head garment fabric subassembly 42. An upper panel 44 is shown attached to a lower panel 46 by sewing or other means along seams 48, 50 and 52. The shape of upper panel 44 is such that when attached to the lower panel 46 the nose pocket 18 is formed. The nose pocket 18 is large enough to form a loose fit over the user's nose (not shown). The upper panel 44 and lower panel 46 are also shaped to form the head garment's mouth opening 16 and nostril opening 14 (only the front edge of the opening can be seen).

Figure 6:
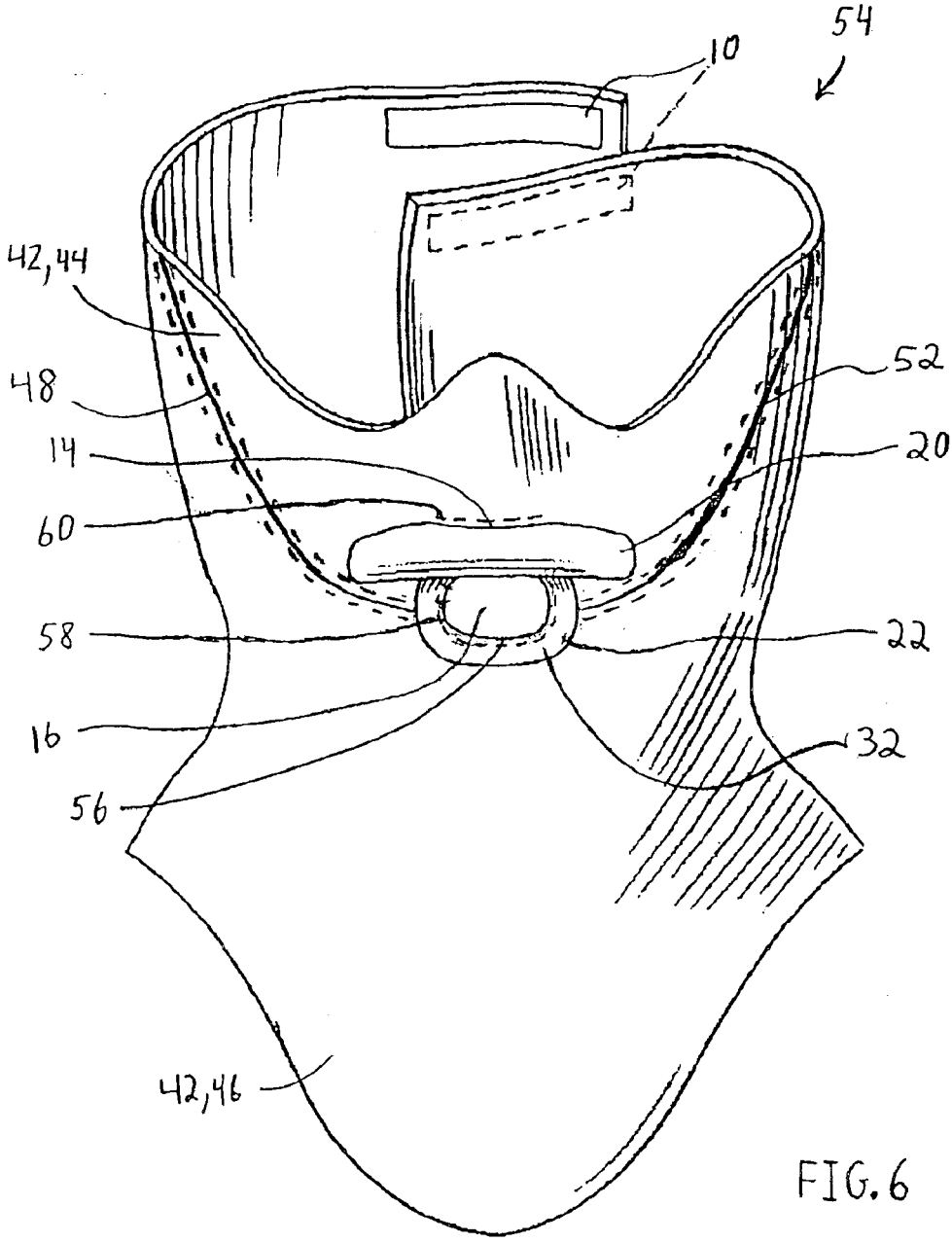
FIG. 6 is a front perspective view of the nose-channel-forming member and mouth disc of a head garment subassembly according to FIG. 1.

FIG. 6 is a front perspective view of the nose-channel-forming member 20 and mouth disc 22 shown mounted in position on the head garment fabric subassembly 42 to form the head garment subassembly 54 as created during the fabrication process. The nose-channel-forming member 20 is shown sewn or otherwise attached to the head garment nostril opening 14 (front edge shown) at the nose channel flange 26 (not shown). The mouth disc 22 is shown sewn or otherwise attached around the head garment mouth opening 16 at the inside edge 56 leaving the majority of the annular part 32 unattached. The seams are indicated by the dashed lines 58, 60.

Figure 7:
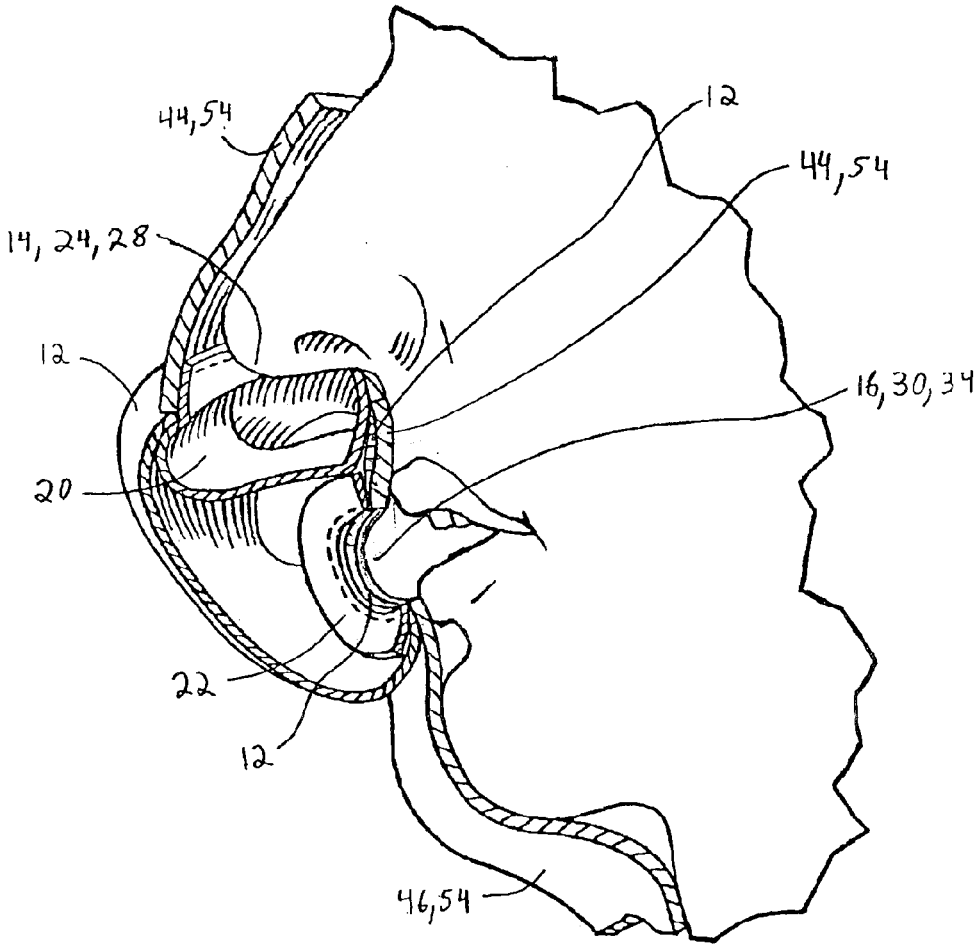
FIG. 7 is an enlarged partial cross-sectional view of the head garment shown in FIG. 1 shown in wearing position on the head of a user.

Referring to the section view in FIG. 7, the mouth-channel-forming member 12 is shown mounted to the head garment subassembly 54. It is attached to the head garment subassembly 54 by deforming both the nose-channel-forming member 20 and mouth disc 22 sufficiently as to be able to insert them into the nostril port 28 and mouth hole 34 of the mouth-channel-forming member 12, respectively, where they return to their original shape locking the mouth-channel-forming member 12 in place. The deformation and insertion steps are not shown but their final interlocked states are depicted.

Figure 8:
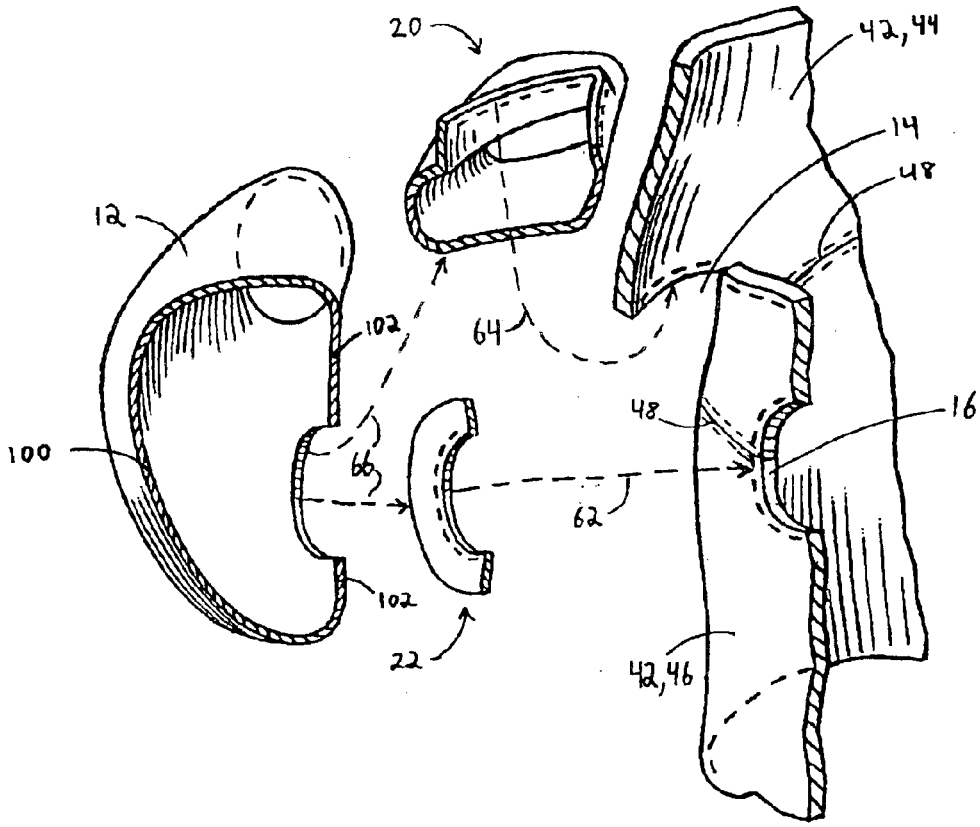
FIG. 8 is a partial exploded view of the parts illustrated in FIGS. 2–4 before assembly into the head garment shown in FIG. 1.

FIG. 8 is a partial exploded section view of the parts helping to illustrate how the parts go together in the preferred embodiment. The arrow 62 shows the mouth disc 22 being attached to the head garment fabric subassembly 42; the arrow 64 shows the nose-channel-forming member 20 being attached to the head garment fabric subassembly 42; and the arrows 66 show the mouth-channel-forming member 12 being attached to the mouth disc 22 and nose-channel-forming member 20. Front wall 100 separates the interior of mouth-channel-forming member 12 from ambient conditions in front of the users mouth.

Figure 9A:
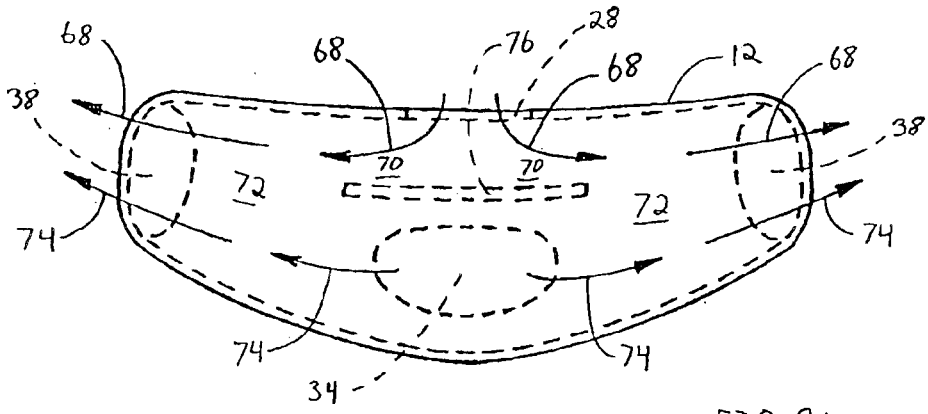
FIGS. 9A, 9B, 9C and 9D are schematic flow diagrams illustrating the exhaled air flow from the user in the FIG. 1 embodiment, and in two variations of the FIG. 1 embodiment, respectively.

FIG. 9A schematically shows the flow path for exhaled air from the nostrils and mouth of the user. The nostril exhaled air follows the path shown by the arrows 68 partially through a nose channel 70 and then through part of the main mouth channel 72. The mouth exhaled air follows the path shown by the arrows 74 entirely through the mouth channel 72. It can also be seen in FIG. 9A how exhaled breath from the nose, arrows 68, and mouth, arrows 74, are kept separate by the barrier formed by the inset nose-channel-forming member, shown schematically by the barrier part 76. The exhaled air from below the nostrils and above the mouth is separated for a short distance, for example, 2–5 cm, and thereafter follow the common mouth channel 72 of the mouth-channel-forming member 12 to its intake/exhaust ports 38. This prevents the moist exhaled breath from coming in contact with the skin around the nose and mouth which is a comfort feature made possible by the dual channel configuration in the preferred embodiment.

Figure 9B:
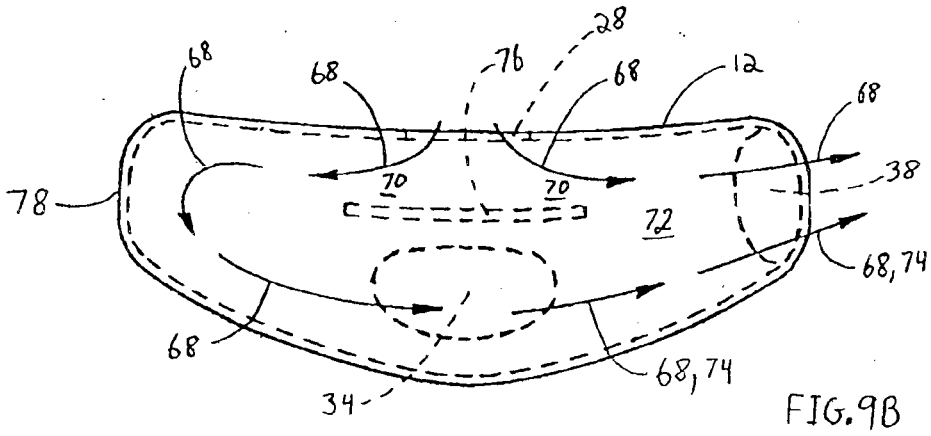
Figure 9C:
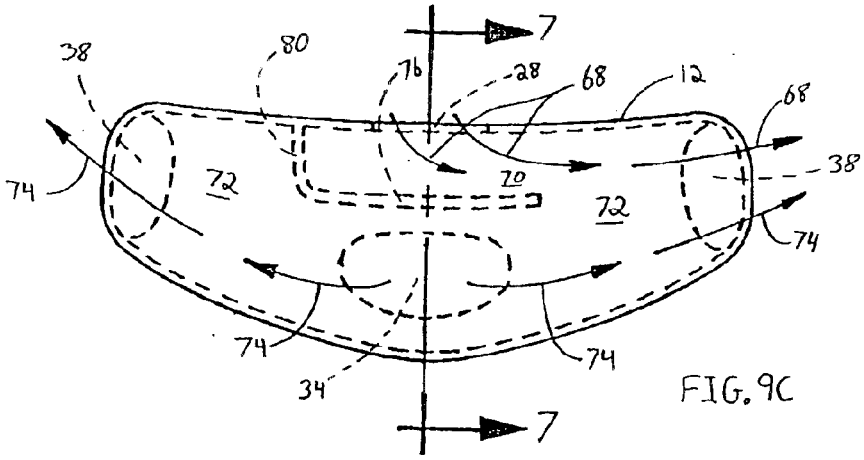

FIG. 9B shows a variant. In this case, one of the intake/exhaust ports 38 of the mouth-channel-forming member 12 is closed off at 78 so to reduce or prevent the cold external air that may pass through the nose channel 70 that would cool the bottom of the user's nose causing discomfort. In this case, some small additional discomfort may be present since the nose exhaled air does pass by the mouth. In the FIG. 9C variant, the latter discomfort is avoided by closing off one intake/exhaust port at 80 of the barrier part 76 formed by the nose-channel-forming member. This design also reduces or eliminates the amount of cold external air that may pass above the barrier part 76 also reducing or eliminating the problem of cooling the bottom of the user's nose.

Figure 9D:
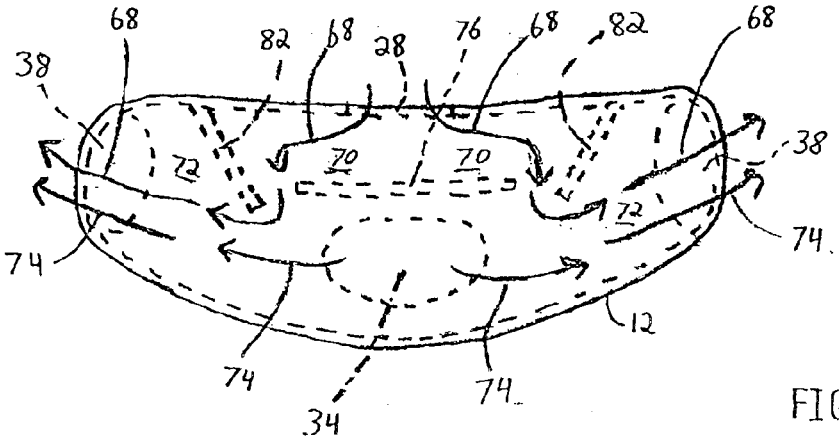

FIG. 9D shows yet another variant. In this case, deflection members 82 are depicted. The air exhaled from the nose follows arrows 68 flowing between the ends of the barrier part 76 and the deflection members 82 and out the intake/exhaust ports 38. The deflection members 82 divert the cold external air that may flow through the nose channel 70 reducing or preventing the above mentioned cooling effect.

The manner of assembling the garment involves attaching the nose-channel-forming member 20 to the head garment nostril opening 14, and the mouth disc 22 to the head garment mouth opening 16, and then inserting both the nose-channel-forming member 20 through the nostril port 28 and mouth disc 22 through the mouth hole 34 of the mouth-channel-forming member 12. This is the preferred way of assembling the garment since it also allows separation of the pieces bordering the mouth and nose for cleaning or drying. But it will be understood that it is not the only way of making a garment incorporating a cold weather breathing apparatus according to the invention and the claims should not accordingly be so limited.

Figure 10:
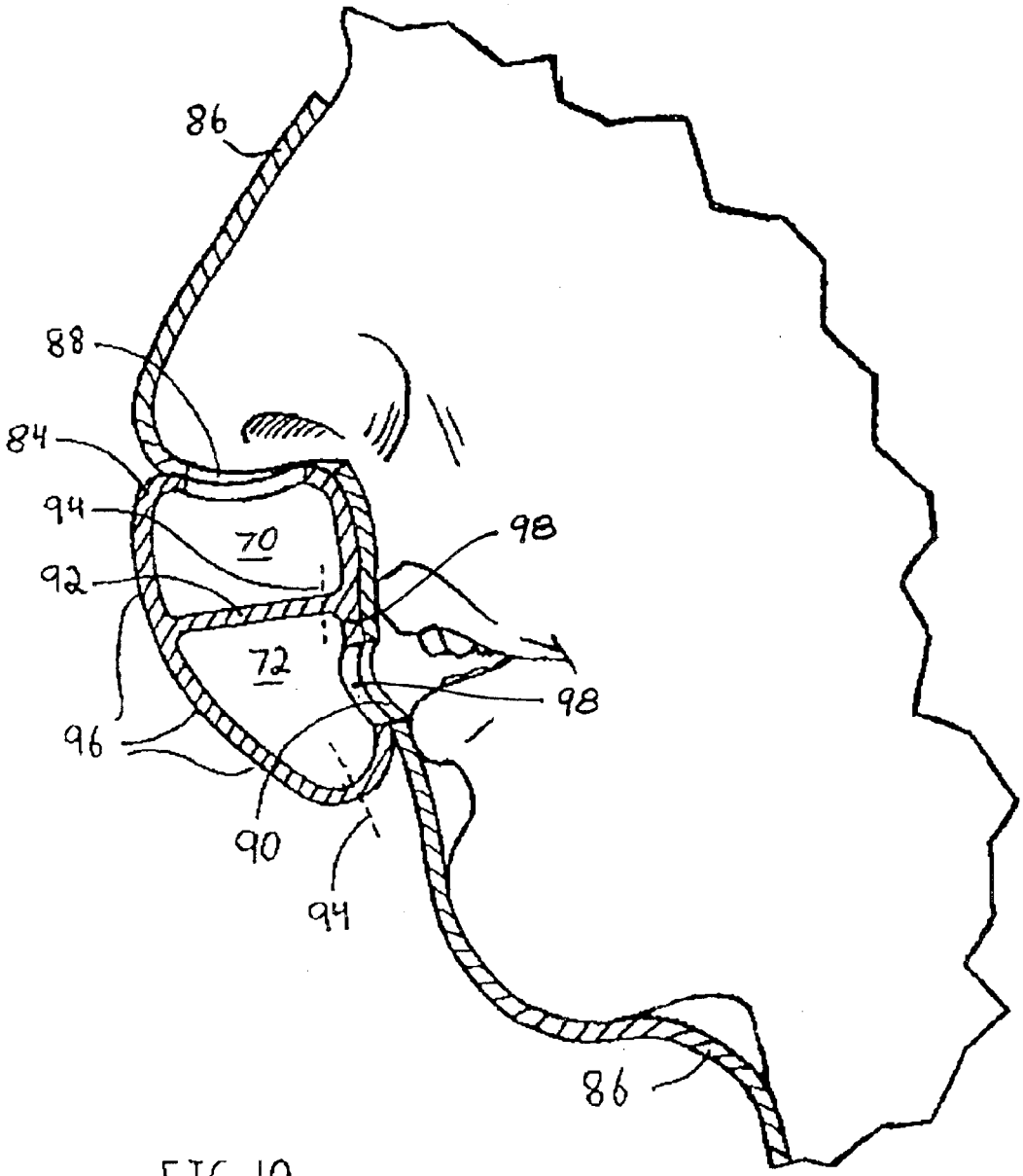
FIG. 10 is an enlarged partial cross-sectional view of a modification of the head garment shown in FIG. 1 shown in wearing position on the head of a user.

FIG. 10 shows a modification which is somewhat simpler in form but does not allow separation of the parts as in the FIG. 1 embodiment. In this case, a single part 84 is attached to a head garment 86 over its nostril 88 and mouth 90 openings similar to those formed in the head garment fabric subassembly 42. A rear wall 98 of part 84 at least partly separates channel 72 from garment 86. It is divided internally by a barrier 92 similar to that formed by the nose-channel-forming member 20 to form a separated nose channel 70 and mouth channel 72 for exhaled air. The usual intake/exhaust ports at the ends of the channels 70, 72 are not shown in this view. This view also shows optional parting lines 94 that server the single part 84 along its entire length. With the single part 84 severed, the front side 96 can be pivoted up and away from the face allowing access to the user's nose and mouth. When released, the shape holding memory nature of the single part 84 will return the apparatus to its original form.

By providing a head garment fabric subassembly 42 with a nose pocket 18 that loosely fits over the bridge of the nose, the use of goggles 8 will easily press the material against the nose creating a seal that prevents the user's breath from entering the goggles 8, which avoids fogging the goggles.

By providing a cold weather head garment 2 with a mouth-channel-forming member 12 and nose-channel-forming member 20 that covers both the mouth and nose, these body parts are shielded from direct exposure to a cold external environment improving user comfort and reduces exposure to frost bit.

By providing both a mouth disc 22 and an nose-channel-forming member 20 that are larger than the mouth hole 34 and nostril ports 28 in the mouth-channel-forming member 12 through which they were inserted during the assembly process, the mouth-channel-forming member 12 can be securely fastened to the head garment subassembly 54.

By providing an independent nose-channel-forming member 20 through which the breath from the nose is expelled and an independent mouth-channel-forming member 12 through which the breath from the mouth is expelled, the moist breath is prevented from excessive contact with the skin around either the nose or mouth creating a dry more comfortable experience.

By providing a mouth-channel-forming member 12 and a nose-channel-forming member 20 both with low resistance to the flow of breath to the external environment, the moist breath is prevented from following a more resistive path into the user's goggles 8 preventing fogging.

By providing the intake/exhaust ports 38 in the mouth-channel-forming member 12 with directional openings that are sideways and oriented both towards the user's face and in a somewhat a downward direction, these openings tend to be shielded from wind and precipitation.

By providing features, such as those shown in FIGS. 8A, 8B, 8C and 8D, that deflects the flow of cold external air that passes through the breathing apparatus 4 away from the nose, the uncomfortable cooling of the user's nose reduced.

By providing a two panel head garment fabric subassembly 42, a nose pocket 18 is formed.

By providing a breathing apparatus single part 84 that is severed along parting lines 94, the user can move the front side 96 away allowing access to his nose and mouth.

Although the description of this invention has been given with reference to particular embodiments, it is not to be construed within a limiting sense. Many variations and modifications will no doubt occur to those skilled in the art. For a definition of the invention, reference is made to the appended claims.

What is claimed is:

1. An apparatus for covering a portion of a user's face, comprising:

a garment adapted and configured to fit over a portion of a user's face and to substantially surround the user's neck:

a first member defining a first hole in fluid communication with the nostrils of the user and a first channel adapted and configured for accepting air flowing from the first hole, the first channel diverting the air laterally from the nostrils, said first member being attached to said garment; and a second member defining a second hole in fluid communication with the mouth of the user and a second channel adapted and configured for accepting air flowing from the second hole, said second member being attached to said garment;

wherein a portion of the first channel is received within the second channel, and the air from the nostrils mixes with the air from the mouth in the second channel.

2. The apparatus of claim 1 wherein the second channel is adapted and configured to divert the air laterally from the mouth, and said second member defines at least one exhaust port for exhausting the nostril air and mouth air to ambient.

3. The apparatus of claim 1 wherein said first member is repeatedly separable from the second channel and repeatedly receivable within the second channel.

4. The apparatus of claim 1 wherein said first member includes a barrier adapted and configured to direct air exhausted from one nostril to flow within the first channel in front of the other nostril.

5. An apparatus for covering a portion of a user's face, comprising:

a garment adapted and configured to fit over a portion of a user's face;

a first member defining a first hole in fluid communication with the nostrils of the user and a first channel adapted and configured for accepting air flowing from the first hole, the first channel diverting the air laterally from the nostrils, said first member including a barrier adapted and configured to direct substantially all of the air exhausted from one nostril to flow within the first channel in front of the other nostril, said first member being attached to said garment; and a second member defining a second hole in fluid communication with the mouth of the user and a second channel adapted and configured for accepting air flowing from the second hole, said second member being attached to said garment.

6. The apparatus of claim 5 wherein the second channel is adapted and configured to divert the air laterally from the mouth, and said second member defines at least one exhaust port for exhausting the nostril air and mouth air to ambient.

7. The apparatus of claim 5 wherein said garment substantially surrounds the user's neck.

8. An apparatus for covering a portion of a user's face, comprising:

a garment adapted and configured to fit over a portion of a user's face, said garment defining a first breathing aperture for alignment with the nostrils of the user and a second breathing aperture for alignment with the mouth of the user, said garment including a flexible member surrounding the second breathing aperture and attached to said garment;

a first separable member defining a first hole in fluid communication with the first breathing aperture, said first member being attached to said garment generally around the periphery of the first hole, said first member including an extension protruding laterally from the first hole; and a second separable member defining a second hole, a third hole, and a flow channel in fluid communication with the second hole and the third hole;

wherein placement of the extension through the second hole and within the flow channel couples said second separable member to said garment and placement of said flexible member through the third hole and within the flow channel couples said second separable member to said garment.

9. The apparatus of claim 8 wherein said garment substantially surrounds the user's neck.

10. An apparatus for covering a portion of a user's face, comprising:

a garment adapted and configured to fit over a portion of a user's face; and a flexible member attached to said garment, said member defining a first hole in fluid communication with the nostrils of the user, a second hole in fluid communication with the mouth of the user, a first channel adapted and configured for accepting air flowing from the first hole, and a second channel adapted and configured for accepting air flowing from the second hole, said member including an internal barrier separating the first channel and the second channel between the mouth and the nostrils, said member defining a third hole spaced laterally from the second hole, the third hole being in fluid communication with the second channel and ambient.

11. The apparatus of claim 10 wherein the third hole is in fluid communication with the first channel and ambient.

12. The apparatus of claim 10 wherein air flowing in the first channel and air flowing in the second channel combine within said member.

13. The apparatus of claim 10 wherein said barrier is adapted and configured to direct substantially all of the air exhausted from one nostril to flow within the first channel in front of the other nostril.

14. An apparatus for covering a portion of a user's face, comprising:

a garment adapted and configured to fit over a portion of a user's face; and a flexible member attached to said garment, said member defining a first hole in fluid communication with the nostrils of the user, a second hole in fluid communication with the mouth of the user, a first channel adapted and configured for accepting air flowing from the first hole, and a second channel adapted and configured for accepting air flowing from the second hole, said member including a front wall and a rear wall, the front wall separating the second channel from ambient conditions in front of the user's mouth, the rear wall at least partly separating the second channel from the garment.

15. The apparatus of claim 14 wherein the front wall separates the first channel from ambient conditions in front of the user's nostrils and the rear wall at least partly separates the first channel from the garment.

16. The apparatus of claim 14 wherein the second channel is adapted and configured to divert the air laterally from the mouth, and said second member defines at least one exhaust port for exhausting the nostril air and mouth air to ambient.

17. The apparatus of claim 14 said first member including a barrier adapted and configured to direct substantially all of the air exhausted from one nostril to flow within the first channel in front of the other nostril.

18. An apparatus for covering a portion of a user's face, comprising:

a garment adapted and configured to fit over a portion of a user's face; and a flexible member attached to said garment, said member defining a first hole in fluid communication with the nostrils of the user, a second hole in fluid communication with the mouth of the user, a first channel adapted and configured for accepting air flowing from the first hole, and a second channel adapted and configured for accepting air flowing from the second hole, said member defining a third hole spaced laterally from the first hole and the second hole, the third hole being in fluid communication with the first channel, the second channel, and ambient, said member including an internal baffle that diverts downward ambient air flowing into the third hole, through the first channel, and into the first hole to minimize the direct flow of air from the third hole over the nostrils of the user.

19. The apparatus of claim 18 wherein said flexible member is fabricated from a material which remains flexible at low temperature.

20. The apparatus of claim 18 wherein said garment substantially surrounds the user's neck.

* * * * *